US012752883B2

(12) United States Patent
Yang

(10) Patent No.: US 12,752,883 B2
(45) Date of Patent: Oct. 6, 2026

(54) PORTABLE AND INFLATABLE BOAT WITH SELF-SECURE AND STORAGE ARRANGEMENT

(71) Applicant: Ming Yang, Calgary (CA)

(72) Inventor: Ming Yang, Calgary (CA)

( * ) Notice: Subject to any disclaimer, the term of this patent is extended or adjusted under 35 U.S.C. 154(b) by 327 days.

(21) Appl. No.: 18/600,657

(22) Filed: Mar. 9, 2024

(65) Prior Publication Data

US 2025/0282449 A1 Sep. 11, 2025

(51) Int. Cl.
*B63B 7/08* (2020.01)
*B63B 7/00* (2020.01)

(52) U.S. Cl.
CPC ..... *B63B 7/082* (2013.01); *B63B 7/085* (2013.01); *B63B 2007/006* (2013.01)

(58) Field of Classification Search
CPC .... B63B 7/082; B63B 7/085; B63B 2007/006
See application file for complete search history.

(56) References Cited

U.S. PATENT DOCUMENTS 3,659,298 A * 5/1972 Edwards ..... B63B 7/082 114/345
5,101,753 A * 4/1992 Hull ..... B63B 7/085 114/345
5,711,240 A * 1/1998 Baker ..... B63B 7/082 114/353
6,142,839 A * 11/2000 Wilcox ..... B63B 34/05 248/641
6,173,671 B1 * 1/2001 Casull ..... B63C 13/00 441/130
9,114,853 B1 * 8/2015 Apple ..... B63B 7/082
2012/0125251 A1 * 5/2012 Leonard ..... B63B 34/05 114/344
2023/0312066 A1 * 10/2023 Weigle ..... B63C 9/23 114/345

FOREIGN PATENT DOCUMENTS

IT 202300003339 A1 * 8/2024 ..... B63B 7/08
NL 2001178 C2 * 11/2009 ..... B63B 7/082
WO WO-2009088290 A1 * 7/2009 ..... B63B 7/082

* cited by examiner

*Primary Examiner* — Marc Q Jimenez
*Assistant Examiner* — Jovon E Hayes
(74) *Attorney, Agent, or Firm* — David & Raymond Patent Firm; Raymond Y Chan

(57) ABSTRACT

A portable and inflatable boat with self-secure and storage arrangement includes a hard shell body and an inflatable floating platform. The hard shell body includes a container unit, made of rigid material, having a concave engaging surface extended between an upper surface and a lower surface to define a concave engagement groove. The inflatable floating platform includes an inflatable floating body which has a circular outer side and a U-shape inner side which defines a U-shape mounting slot forming a convex engagement ridge along the U-shape mounting slot. After inflation, the U-shape mounting slot is configured to fittingly receive the hard shell body therein and the convex engagement ridge presses against the concave engaging surface so as to engage the hard shell body with the inflated inflatable floating body securely.

20 Claims, 9 Drawing Sheets

PORTABLE AND INFLATABLE BOAT WITH SELF-SECURE AND STORAGE ARRANGEMENT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to portable and inflatable boat, and more particularly to a portable and inflatable boat with self-secure and storage arrangement, wherein the engagement of its support frame and floating unit is self-secured automatically after inflation of the floating unit and at least one storage arrangement is provided in the support frame.

Description of Related Arts

Inflatable fishing boats are commonly used for fishing on a lake or a reservoir. As shown in FIG. 1 and FIG. 2, conventional inflatable fishing boats work much like any other inflatable boat that needs to be inflated before use. This is typically done using a manual or electric pump. Once inflated, the boat becomes rigid and buoyant, ready for use on the water. Inflatable fishing boats are typically made from durable materials like PVC or Hypalon. These materials are tough enough to withstand punctures and abrasions while remaining lightweight and portable. Some inflatable fishing boats feature multiple air chambers. Even if one chamber is punctured, the others will keep the boat afloat, enhancing safety. Additionally, inflatable boats often have wide hulls or pontoons, providing stability on the water, even in rough conditions.

One of the significant advantages of inflatable fishing boats is their portability. When deflated, they can be rolled up or folded down to a compact size, making them easy to transport in a car trunk or storage bag. This feature makes them ideal for anglers who don't have space for a traditional boat or who want to explore remote fishing spots.

Besides the inflatable fishing boats that have mounts for oars, allowing the user to row manually as shown in FIG. 1 and FIG. 2. Improved inflatable fishing boats, as shown in FIG. 3 and FIG. 4, are provided recently that can both allow the user to row manually and accommodate small outboard motors or electric trolling motors for powered propulsion by mounting a rigid frame 1 between two opposing sides of the circular inflatable buoy 2.

However, the electric motor powered inflatable fishing boat, as shown in FIG. 3, merely allows the user to sit on a sideboard 1.1 extended on top of a side of the inflatable buoy 2 that adversely affects the stability of the inflatable fishing boat and operate the control unit 1.2, wherein the weight of the user applied to one side of the inflatable fishing boat may cause the fishing boat capsizing or overturning. Also, when the user has to stand up to perform some desired activities during fishing, the two feet of the user can only stand in two small limiting semicircular spaces 2.1, 2.2 respectively. It is difficult for the user to keep balance during the fishing operation. It is always a hazard to the user of such conventional inflatable fishing boat to prevent overturning of the boat or falling into the water.

FIG. 4 illustrates an alternative mode of the rigid frame 1 which provide two side panels 1.32, 1.32 extended from two sides thereof that allows the user to put a chair thereon for the user to sit so that the weight of the user can apply to a central position of the inflatable buoy 2 of the inflatable fishing boat, or alternatively the user may stand on the two side panels 1.31, 1.32. However, if a chair put on the two side panels 1.31, 1.32, then the user has no where to stand. Accordingly, the conventional inflatable fishing boat as shown in FIG. 4 fails to provide both the sitting and standing postures for the user to fish while maintaining good balance for the user and excellent stability for the inflatable fishing boat.

One common drawback of the buoy type inflatable fishing boat as shown in FIG. 3 and FIG. 4 is the difficulty of mounting the rigid frame securely in position because the inflatable buoy is made of PVC or Hypalon in hollow ring shape without any fastening means provided. It is hard to operate the control unit and unsafe to sit thereon once the rigid frame 1 is loose, especially when the user sits on the sideboard 1.1 at one end of the rigid frame 1, the air in the inflatable buoy 2 will be compressed sidewards due to the weight of the user.

Further, it is preferred to provide storage compartment for the user to store required fishing equipment and fishes caught. Where and how to provide such storage compartment(s) without complicating the configuration and increasing the manufacturing cost of the inflatable fishing boat are unsolved problems to these conventional inflatable fishing boat.

Another unsolved problem is the transportation of the inflatable fishing boat. Even though the inflatable fishing boat is configured to be carried in the trunk of most vehicles but the user still has to carry the relatively bulky and heavy inflatable fishing boat from the vehicle to the shore of lake or reservoir.

SUMMARY OF THE PRESENT INVENTION

The invention is advantageous in that it provides a portable and inflatable boat with self-secure and storage arrangement, which does not require any fastening means to secure the inflatable floating body and the hard shell body integrally together to form the inflatable boat, wherein after the inflatable floating body is inflated with air to a standard pressure, the air compress in the inflatable floating body applies a radial and inward pressure against the hard shell body to securely mount the hard shell body in position in such a manner that the hard shell body is unable to move upward, downward nor sideward with respect to the inflatable floating body.

Another advantage of the invention is to provide a portable and inflatable boat, which inflatable floating body and hard shell body are self-secured and engaged with each other by inflating air in the inflatable floating body to form an integral body. Also, the engagement of the inflatable floating body and the hard shell body is self-released and after the deflation of the inflatable floating body and the inflatable floating body and the hard shell body are separated automatically.

Another advantage of the invention is to provide a portable and inflatable boat, which allows a sitting post of a seat unit to detachably mount on the hard shell body so that the user may sit on the inflatable boat in a stable manner while the entire upper surface of the hard shell body forms a standing and operation platform for the user to optionally stand thereon and/or operate the fishing equipment thereon during fishing.

Another advantage of the invention is to provide a portable and inflatable boat, wherein the inflatable floating body is configured to have a U-shape defining a concave engagement groove to receive and mount the hard shell body therein securely while the sitting post is arranged in a central portion of the inflatable boat, such that the weight of the user sat on the seat unit is applied to the central portion of the inflatable boat to ensure a stable and balance sitting posture for the user.

Another advantage of the invention is to provide a portable and inflatable boat, which hard shell body is configured to provide a plurality of engaging ribs spacedly protruded on the concave engaging surface defining the concave engagement groove to press against the inflated inflatable floating body, so as to further enhance the engagement between the inflatable floating body and the hard shell body and prevent any relative sideward movement of the inflated floating body with respect to the hard shell body.

Another advantage of the invention is to provide a portable and inflatable boat, wherein the sitting post is rotatably mounted on the hard shell body so that the user may change his or her facing position by rotating the sitting post with respect to the hard shell body while the feet of the user sat on the seat unit can be rest on the upper surface of hard shell body or the top side of the inflatable floating body.

Another advantage of the invention is to provide a portable and inflatable boat, which hard shell body is configured to be a container like a suitcase that has a storage cavity provided therein and comprises a cover to enclose the storage cavity, such that the user may store the inflatable floating body after deflation in the storage cavity or use the storage cavity to store personal items, fishing equipment and/or even the fishes caught in the storage cavity while the inflatable floating body is inflated and securely engaged with the hard shell body to form the inflatable boat in use. In other words, the hard shell body is a hollow body so that it is light in weight and may also be floatable when the hard shell body is made of plastic or wood.

Another advantage of the invention is to provide a portable and inflatable boat, which hard shell body comprises one or more wheels for ease of dragging the floating boat to roll on the ground or allowing the user to carry the hard shell body with the deflated floating boat received therein sliding on the ground.

Another advantage of the invention is to provide a portable and inflatable boat, which is light in weight, enabling the user to preassemble and carry directly with a vehicle such as a pickup and or a truck.

Another advantage of the invention is to provide a portable and inflatable boat, which further provides a top panel mounted on the inflated floating body so as to combine with the upper surface of the hard shell body to provide an enlarged rigid surface for the user. In addition, multiple handles are able to be mounted on the top side 301 of the inflatable floating body to facilitate one or more passengers sitting on the top panel to grip thereto to enhance stability and balancing of the passengers.

Another advantage of the invention is to provide a portable and inflatable boat, which is configured to be functioned as a floating platform on a swimming pool or other water surface that swimmers can rest thereon or simply grip to the handles.

Additional advantages and features of the invention will become apparent from the description which follows and may be realized by means of the instrumentalities and combinations particular point out in the appended claims.

According to the present invention, the foregoing and other objects and advantages are attained by a portable and inflatable boat with self-secure and storage arrangement, comprising:

a hard shell body, comprising a container unit, made of rigid material, having an upper surface, a lower surface, an end surface extended between end sides of the upper surface and the lower surface, and a concave engaging surface extended between the upper surface and the lower surface to define a concave engagement groove; and an inflatable floating platform, comprising an inflatable floating body which is a hollow body made of durable material and has a circular outer side and a U-shape inner side which defines a U-shape mounting slot extended from the outer side to a central portion thereof, wherein the U-shape inner side forms a convex engagement ridge along the U-shape mounting slot when the inflatable floating body is inflated with air therein, wherein the U-shape mounting slot of the inflatable floating body after inflation is configured to have a size and a shape to fittingly receive the hard shell body therein and the convex engagement ridge of the inflatable floating body after inflation is shaped and sized to match and press against the concave engaging surface of the container unit of the hard shell body so as to engage the hard shell body with the inflated inflatable floating body securely due to a predetermined air pressure in the inflated inflatable floating body.

In one embodiment, a storage cavity is defined in the container unit and has an upper opening on the upper surface, and that the container body of the hard shell body further comprises a cover configured to be detachably mounted on the upper surface of the container unit to enclose the storage cavity.

In one embodiment, the storage cavity of the container unit of the hard shell body is at least large enough to receive the inflatable floating platform after deflation therein.

In one embodiment, the inflatable floating platform further comprises a bottom panel, which is integrally mounted on a bottom side of the inflatable floating body across the U-shape mounting slot to ensure the size and the shape of the U-shape mounting slot, to guide an engagement of the inflated inflatable floating body and the hard shell body and to support the bottom surface of the container unit of the hard shell body.

In one embodiment, the hard shell body comprises a seat base configured to detachably connect a sitting post of a seat unit in a rotatable manner, wherein the seat unit further comprises a seat member connected to a top portion of the sitting post which is upwardly extended from the upper surface of the hard shell body. Preferably, the seat base is arranged at the upper surface of the hard shell body and positioned adjacent to a curved engaging end thereof, so that the user may sit on the inflatable boat in a stable manner while the entire upper surface of the hard shell body engaged with the inflatable floating body while the upper surface of the hard shell body forms a standing and operation surface for the user to operationally stand thereon and/or operate the fishing equipment thereon during fishing.

In one embodiment, the hard shell body has a plurality of engaging ribs spacedly protruded on the concave engaging surface to press against the inflated inflatable floating body, so as to further enhance the engagement between the inflatable floating body and the hard shell body and prevent any relative sideward movement of the inflated floating body with respect to the hard shell body.

In one embodiment, the hard shell body comprises one or more wheels rotatably to an outer end thereof, wherein the one or more wheels are configured to be rolling on the ground for transportation of the hard shell body with the inflatable floating body stored in the storage cavity when it is not inflated, or the entire portable and inflatable boat when the inflatable floating body is inflated and engaged with the hard shell body.

In one embodiment, the inflatable floating platform further comprises a rudder installed to the bottom side thereof.

In one embodiment, the inflatable floating body further comprises a locker arrangement at an open end of the mounting slot for holding and locking the hard shell body in the mounting slot after the inflatable floating body is inflated.

In accordance with another aspect of the invention, the present invention provides a method of assembling a portable and inflatable boat, comprising steps of:

positioning a hard shell body in a U-shape mounting slot of an inflatable floating body with a curved engaging end of the hard shell body positioning at a bottom end of the U-shape mounting slot; and inflating the inflatable floating body with air to a predetermined air pressure therein until a convex engagement ridge of a U-shape inner side of the inflatable floating body presses against a concave engaging surface extended between an upper surface and a lower surface of the hard shell body such that the hard shell body is engaged with the inflatable floating body to form the portable and inflatable boat.

In accordance with another aspect of the invention, the present invention provides an alternative method of assembling a portable and inflatable boat, comprising steps of:

inflating an inflatable floating body with air until a U-shape inner side thereof forming a convex engagement ridge and defining a U-shape mounting slot;

inserting a hard shell body in the U-shape mounting slot of the inflatable floating body via an open end of the U-shape mounting slot until a curved engaging end of the hard shell body positioning at a bottom end of the U-shape mounting slot; and further inflating the inflatable floating body with air to a predetermined air pressure until the convex engagement ridge of a U-shape inner side of the inflatable floating body presses against a concave engaging surface extended between an upper surface and a lower surface of the hard shell body such that the hard shell body is engaged with the inflatable floating body to form the portable and inflatable boat.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
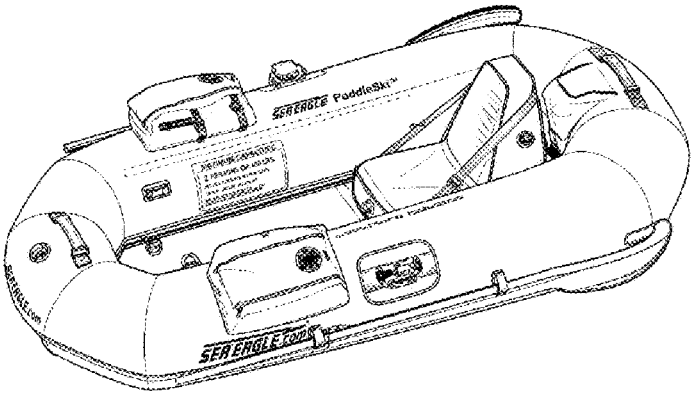
FIG. 1 PRIOR ART
FIG. 1 is a perspective view of a first conventional inflatable fishing boat generally known in the marketplace as background information for understanding the invention.
Figure 2:
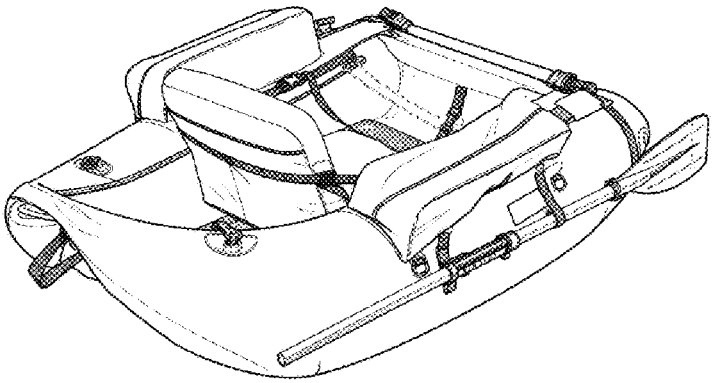
FIG. 2 PRIOR ART
FIG. 2 is a perspective view of a second conventional inflatable fishing boat generally known in the marketplace as background information for understanding the invention.
Figure 3:
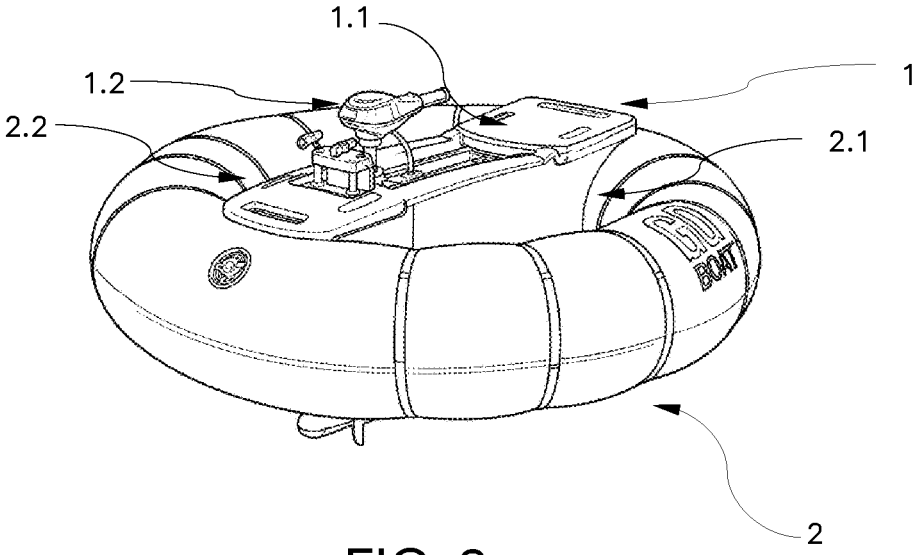
FIG. 3 PRIOR ART
FIG. 3 is a perspective view of a third conventional inflatable fishing boat generally known in the marketplace as background information for understanding the invention.
Figure 4:
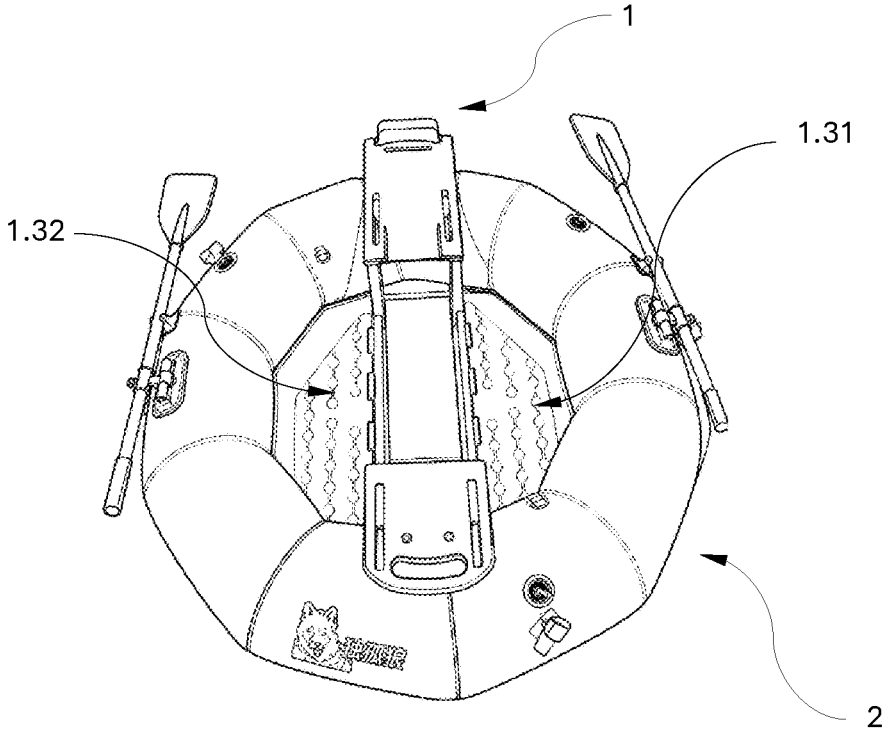
FIG. 4 PRIOR ART
FIG. 4 is a perspective view of a fourth conventional inflatable fishing boat generally known in the marketplace as background information for understanding the invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

In the description of the present invention, unless explicitly stated otherwise and qualified, terms such as "connected," "attached," and "fixed" should be construed broadly. For instance, these terms may indicate a permanent connection or a detachable one, or they may refer to a whole unit. They can signify a mechanical linkage, an electrical connection, direct coupling, or indirect interaction through an intermediary medium. Whether these terms imply an internal connection between two elements or an interactive relationship between them will depend on the specific context and the understanding of those skilled in the art.

Throughout this invention, unless explicitly stated otherwise and qualified, when the first feature is described as being "above" or "below" the second feature, this may entail direct physical contact between the two features. Alternatively, it may signify that the first and second features are not in direct contact but are linked through the involvement of additional features. Additionally, the description of the first feature being "above," "over," or "on top of" the second feature includes scenarios where the first feature is positioned directly above or diagonally above the second feature or simply means that the first feature is situated at a higher horizontal level than the second feature. Conversely, when the first feature is referred to as "below," "under," or "beneath" the second feature, it encompasses cases where the first feature is directly below or diagonally below the second feature or simply implies that the first feature's horizontal height is less than that of the second feature.

In this embodiment's description, terms such as "up," "down," "right," and "left" are used to describe orientations or positional relationships. These descriptions are based on the orientations or positions depicted in the drawings and are employed for ease of explanation and simplification of operation. They should not be construed as indications or implications that the device or element being discussed must possess a specific orientation, be constructed in a particular manner, or operate exclusively in a certain orientation. Furthermore, terms such as "first" and "second" are employed solely for the purpose of distinction in the description and do not carry any particular significance.

Referring to FIG. 5 to FIG. 11, a portable and inflatable boat according to a preferred embodiment of the present invention is illustrated, which comprises a hard shell body 20 and an inflatable floating platform 30.

Figure 5:
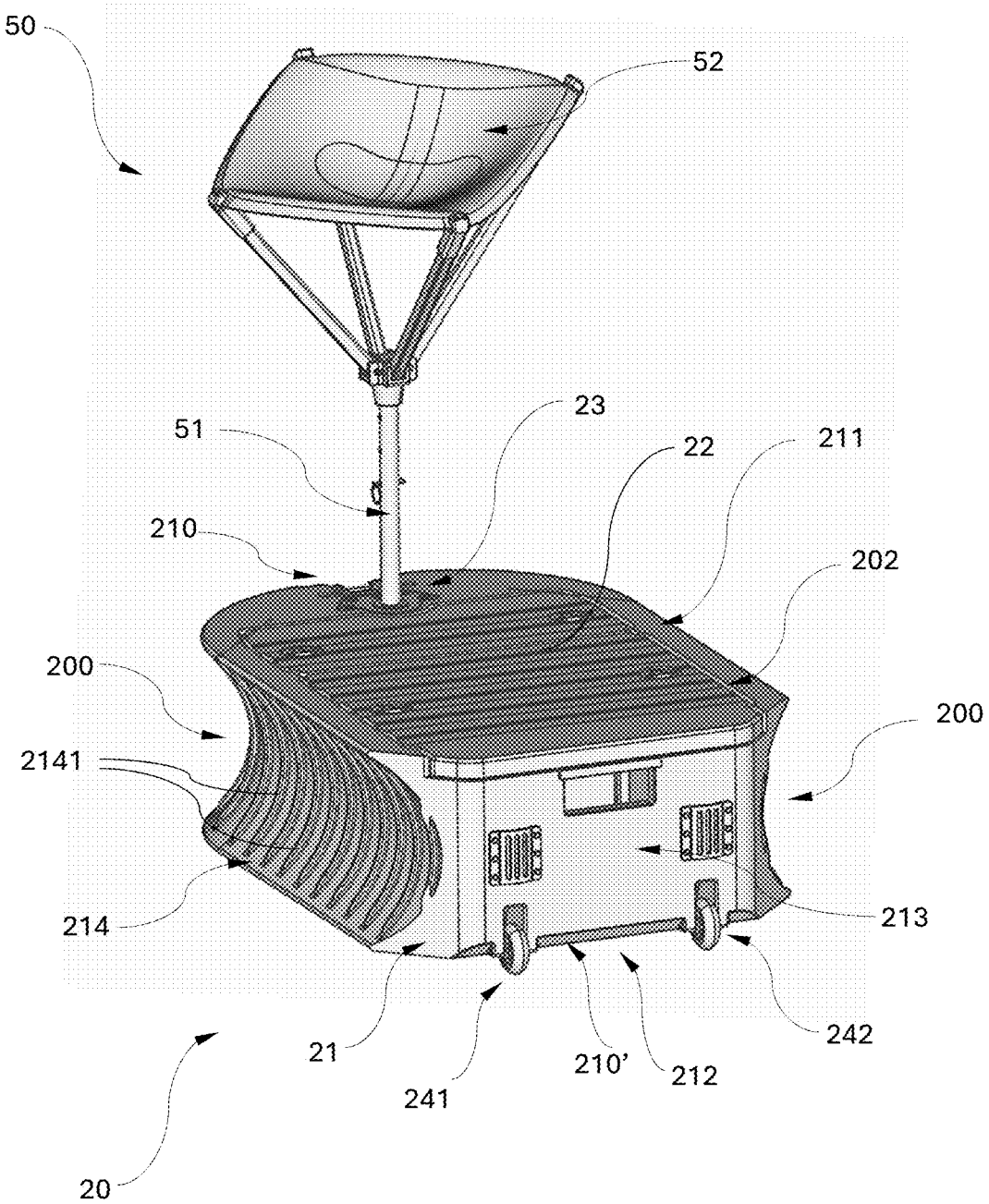
FIG. 5 is a perspective view of a hard shell body of a portable and inflatable boat according to a preferred embodiment of the present invention.
Figure 6:
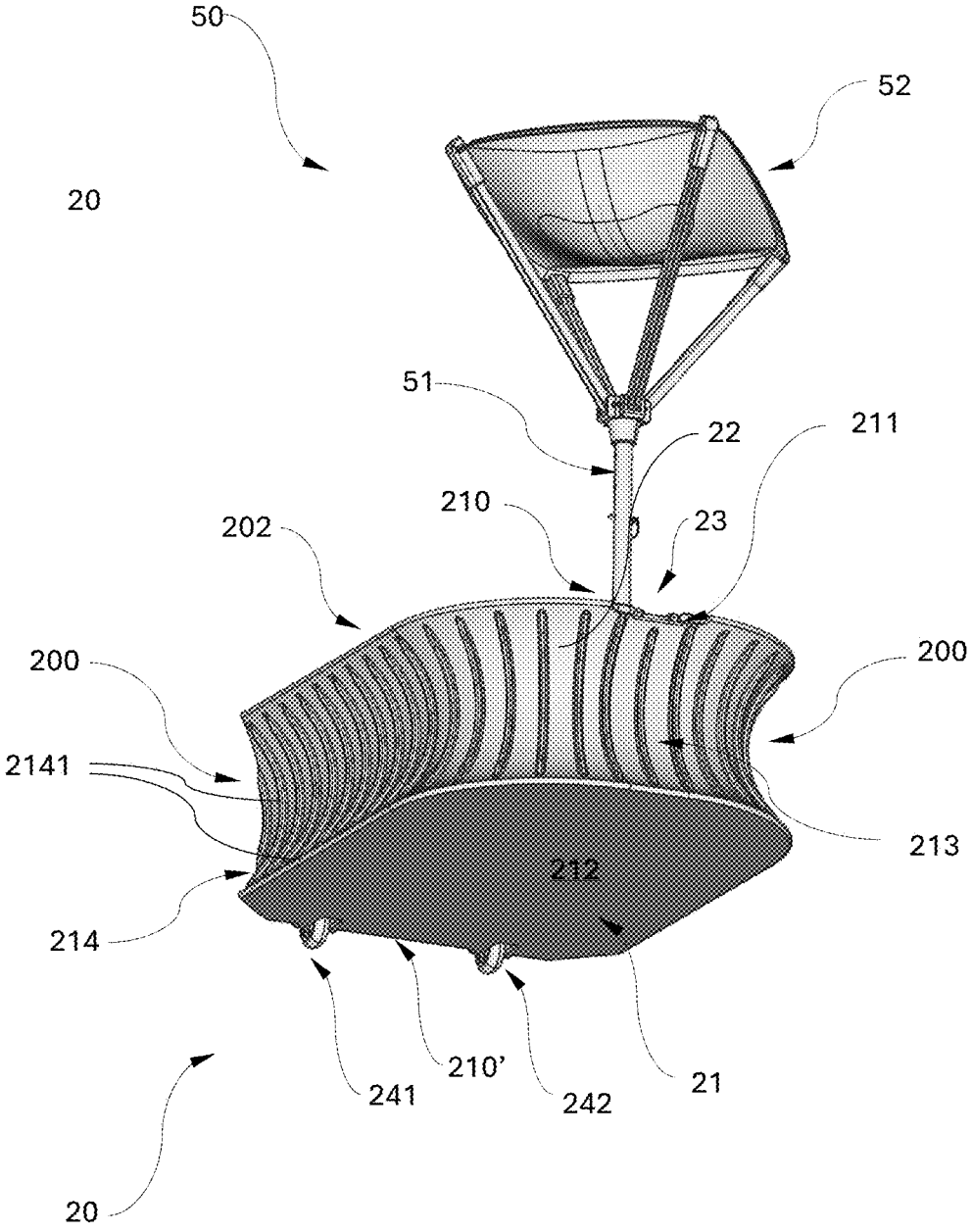
FIG. 6 is another perspective view of the hard shell body of the portable and inflatable boat according to the above preferred embodiment of the present invention.
Figure 13:
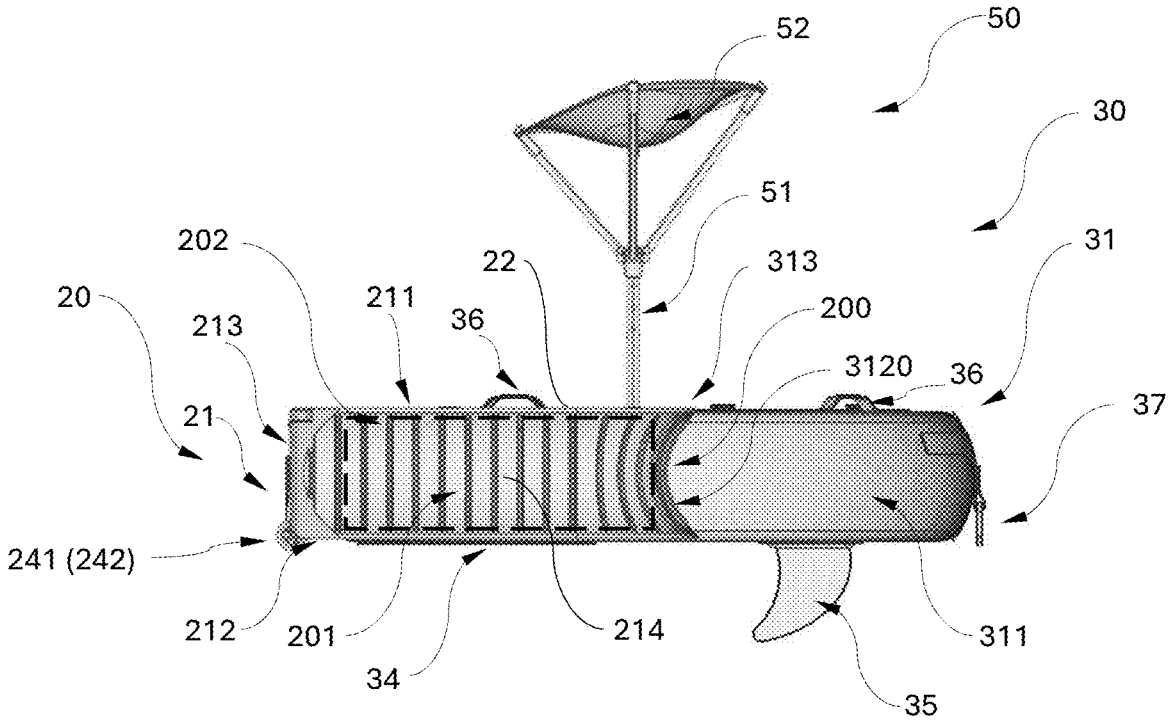
FIG. 13 is a partial sectional elevation view of the portable and inflatable boat after assembled according to the above preferred embodiment of the present invention.

The hard shell body 20, as shown in FIG. 5, FIG. 6 and FIG. 13, comprises a container unit 21, made of rigid material, having an upper surface 211, a lower surface 212, an end surface 213 extended between end sides of the upper surface 211 and the lower surface 212, and a concave engaging surface 214 extended between the upper surface 211 and the lower surface 212 to define a concave engagement groove 200.

According to the preferred embodiment, the hard shell body 20 provides a storage arrangement which is configured by a storage cavity 201 and a cover 22, wherein the storage cavity 201 is formed in the container unit 21 of the hard shell body 20 and an upper opening 202 formed on the upper surface 211 communicating the storage cavity 201 with outside. The hard shell body 20 further comprises the cover 22 configured to be detachably mounted on the upper surface 211 of the container unit 21 to enclose the storage cavity 201. It is worth mentioning that the storage cavity 201 2 of the container unit 21 of the hard shell body 20 is preferred at least large enough to receive the inflatable floating platform 30 after deflation therein.

Figure 7:
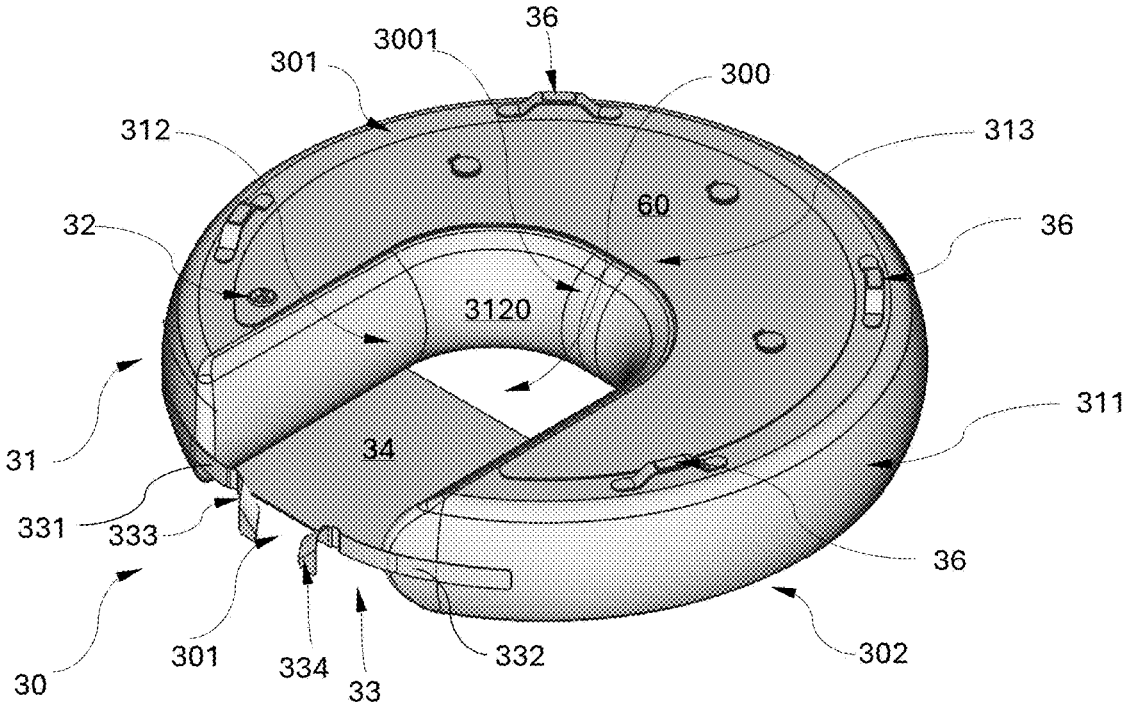
FIG. 7 is a perspective view of an inflatable floating platform of the portable and inflatable boat according to a preferred embodiment of the present invention.
Figure 8:
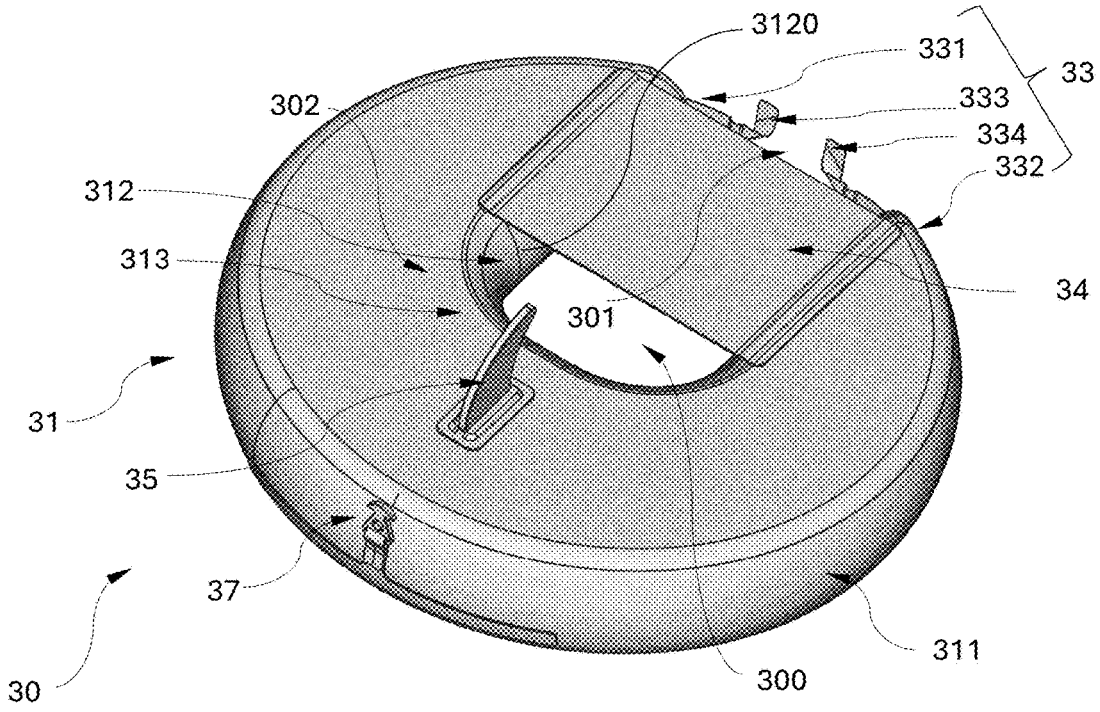
FIG. 8 is another perspective view of the inflatable floating platform of the portable and inflatable boat according to the above preferred embodiment of the present invention.
Figure 9:
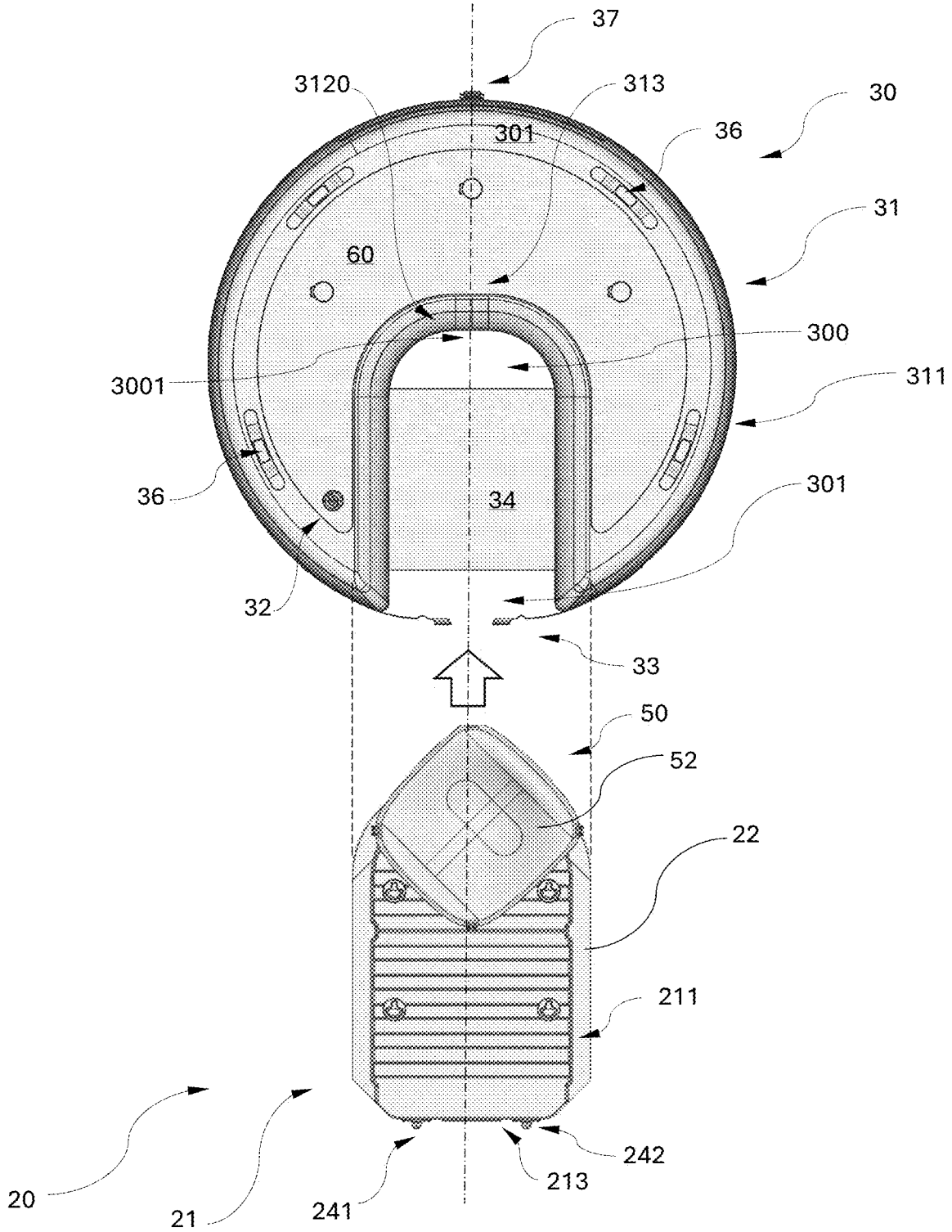
FIG. 9 is a top view of the portable and inflatable boat before assembling according to the above preferred embodiment of the present invention.
Figure 10:
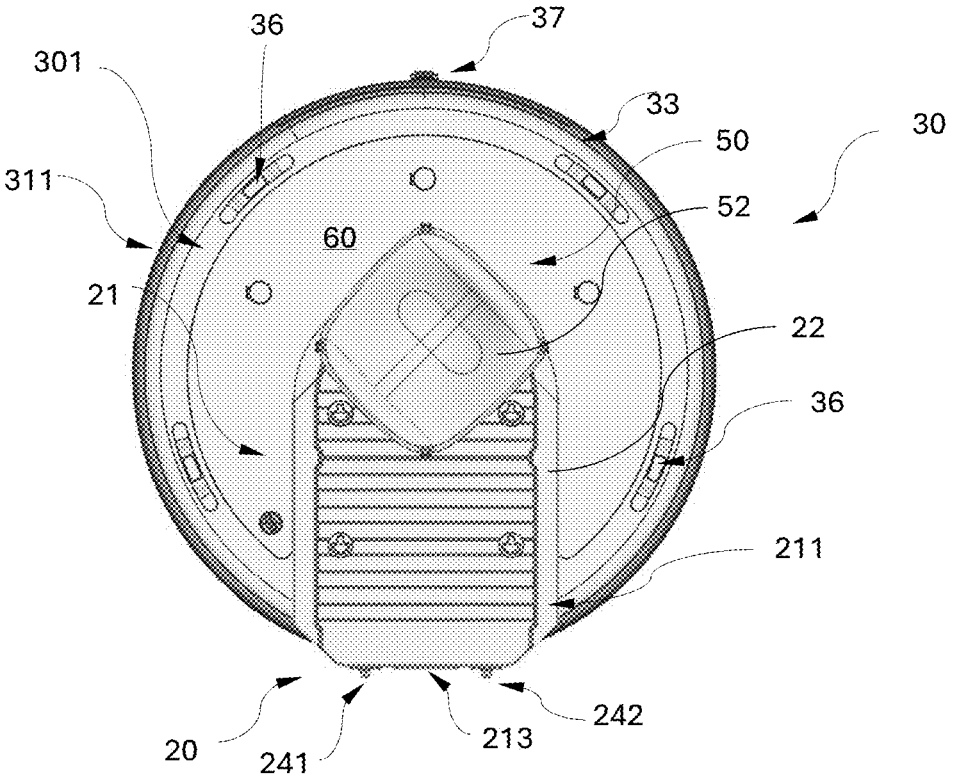
FIG. 10 is a top view of the portable and inflatable boat after assembled according to the above preferred embodiment of the present invention.
Figure 11:
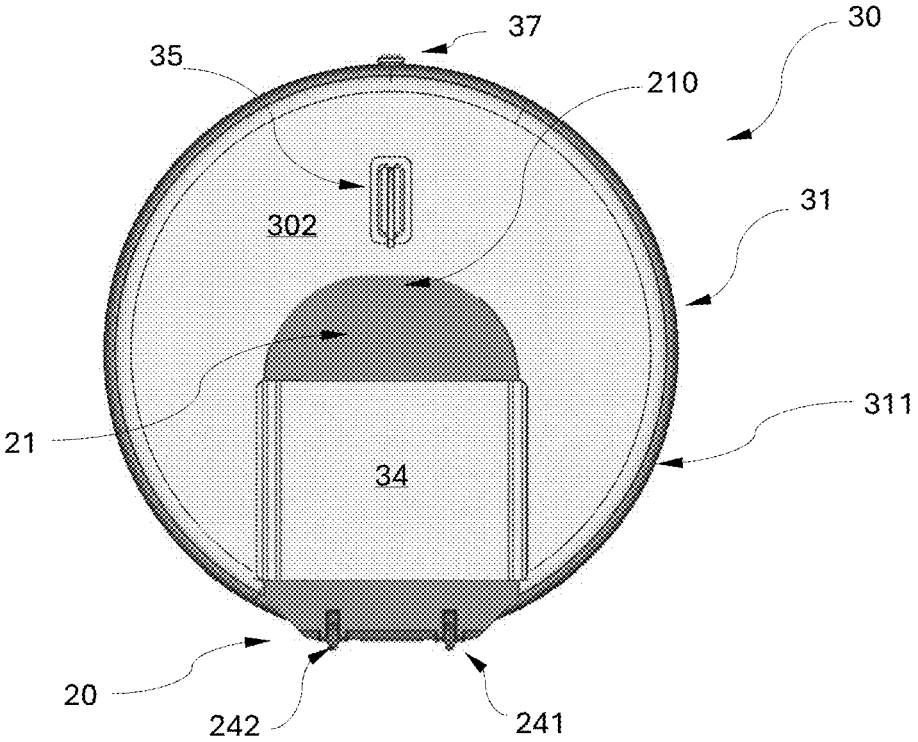
FIG. 11 is a bottom view of the portable and inflatable boat after assembled according to the above preferred embodiment of the present invention.

The inflatable floating platform 30 comprises an inflatable floating body 31 which is a hollow body made of durable material and can float on water after being inflated air therein via an inflation valve 32 provided on the inflatable floating body 31. The inflatable floating body 31 has a circular outer side 311 and a U-shape inner side 312 defined between a top side 301 and a bottom side 302 of the inflatable floating body 31, wherein the U-shape inner side 312 defines a U-shape mounting slot 300 extended from the outer side 311 to a central portion 313 thereof. The U-shape inner side 312 forms a convex engagement ridge 3120 along the U-shape mounting slot 300 when the inflatable floating body 31 is inflated with air therein, as shown in FIG. 7 and FIG. 8.

Figure 12:
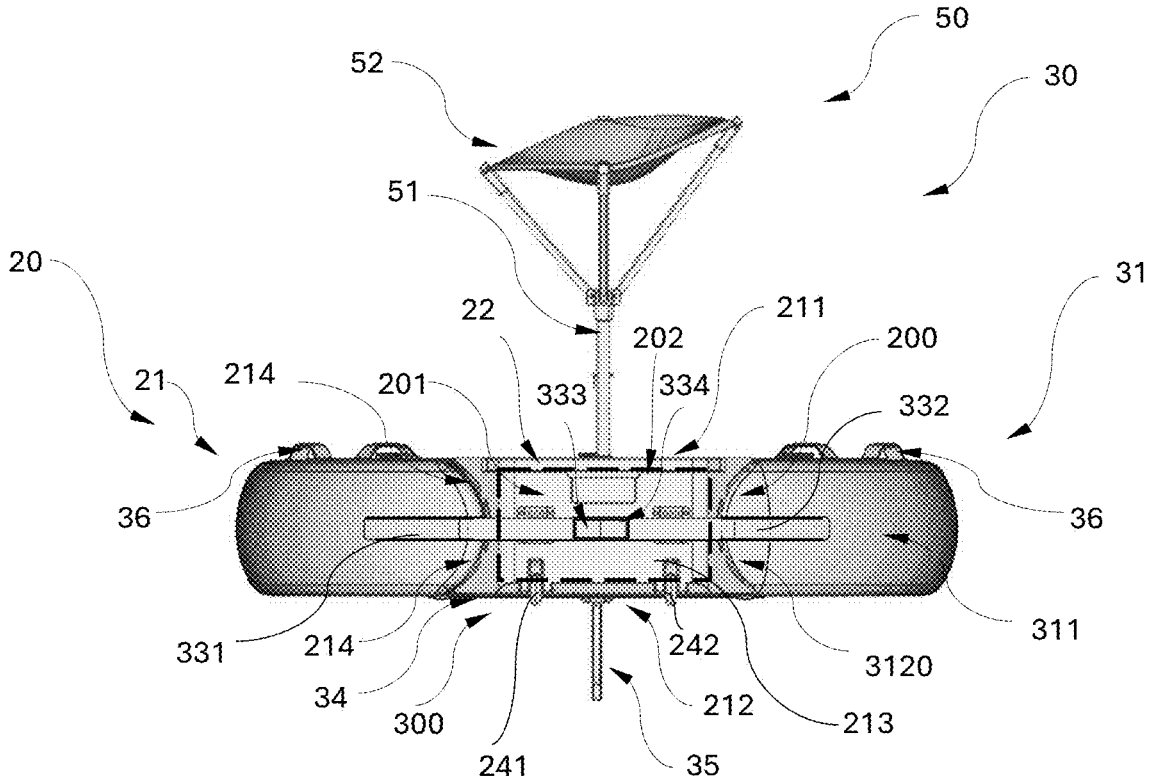
FIG. 12 is an end view of the portable and inflatable boat after assembled according to the above preferred embodiment of the present invention.

Referring to FIG. 12 and FIG. 13, the U-shape mounting slot 300 of the inflatable floating body 31 after inflation is configured to have a size and a shape to fittingly receive the hard shell body 20 therein and the convex engagement ridge 3120 of the inflatable floating body 31 after inflation is shaped and sized to match and press against the concave engaging surface 214 of the container unit 21 of the hard shell body 20 so as to engage the hard shell body 20 with the inflated inflatable floating body 31 securely due to a predetermined air pressure in the inflated inflatable floating body 31.

It is appreciated that, before inflation, there is no air pressure in the inflatable floating body 31 and the deflated inflatable floating body 31 is not engaged with the rigid hard shell body 20. In other words, the portable and inflatable boat 31 can simply be disassembled by deflating the inflatable floating boat 31 through the inflation valve 32 such that the convex engagement ridge 3120 of the inflatable floating body 31 automatically disengaged with the concave engaging surface 214 of the container unit 21 of the hard shell body 20.

On the other hand, after inflation, the inflatable floating body 31 is filled with air though the inflation valve 32 until under the predetermined air pressure, as shown FIG. 12, such that the inner side 312 of the inflatable floating body 31 extends in the concave engagement groove 200 and the convex engagement ridge 3120 curvedly presses against the concave engaging surface 214 so as to assemble the inflatable floating platform 30 with the hard shell body 20, as shown in FIG. 10 to FIG. 13. The engagement of the convex engagement ridge 3120 and the concave engaging surface 214 renders a secure connection between the inflatable floating body 311 of the inflatable floating platform 30 and the container unit 21 of the hard shell body 20 that prevent the hard shell body 20 from moving upward or downward with respect to the inflatable floating body 311.

Further, the hard shell body 20 has a plurality of engaging ribs 2141 spacedly protruded on the concave engaging surface 214 and extended from an upper portion of the concave engaging surface 214 adjacent to the upper surface 211 to a lower portion of the concave engaging surface 214 adjacent to the lower surface 212, so that after the inflatable floating body 31 is inflated to the predetermined air pressure, each of the plurality of engaging ribs 2141 substantially presses against the inner side 312 of the inflated inflatable floating body 31 to provide a friction significantly formed between the concave engaging surface 213 and the convex engaging surface 3120 to prevent relative lateral movement between the inflated inflatable floating body 31 and the hard shell body 20, so as to further enhance the engagement between the inflatable floating body 31 and the hard shell body 20 by avoiding any relative sideward movement of the inflated floating body 31 with respect to the hard shell body 20.

According to the preferred embodiment, referring to FIG. 7 and FIG. 12, the inflatable floating body 30 further comprises a locker arrangement 33 at an open end 301 of the U-shape mounting slot 300 for holding and locking the hard shell body 20 in the U-shape mounting slot 300 after the inflatable floating body 20 is inflated. The locker arrangement 33 comprises a first locking element 331 having one end affixed and extended from a first end of the outer side 311 of the inflatable floating body 31, a second locking element 332 having one end affixed and extended from a second end of outer side 311 of the inflatable floating body 31, a pair of first and second lockers, embodied as hook and loop fasteners, 333, 334 provided at another frees ends of the first and second locking elements 331, 332, as shown in FIG. 7, such that, after the hard shell body 20 is assembled in the U-shape mounting slot 300 of the inflatable floating body 31, as shown in FIG. 12, the first and second lockers 333, 334 can be fastened with each other to connect the first and second locking elements 331, 332 so as to tight and lock the hard shell body 20 in the U-shape mounting slot 300, so as to prevent the hard shell body 20 from withdrawing from the U-shaped mounting slot 300 via the open end 301 thereof while any external pulling force applied to the hard shell body 20 is larger than the friction between the applied to the concave engaging surface 214 with the engaging ribs 2141 of the hard shell body 20 and the convex engaging surface 3120 of the inner side 312 of the inflatable floating body 31.

According to the preferred embodiment, as shown in FIG. 7-FIG. 8 and FIG. 11-FIG. 13, the inflatable floating platform 30 further comprises a bottom panel 34, which is integrally mounted on a bottom side 302 of the inflatable floating body 31 across the U-shape mounting slot 300 for ensuring the size and the shape of the U-shape mounting slot 300, guiding an engagement of the inflated inflatable floating body 31 and the hard shell body 20 and supporting the bottom surface 212 of the container unit 21 of the hard shell body 20.

Referring to FIG. 5, FIG. 10, FIG. 12, and FIG. 13, the upper surface 211 of the inflatable floating body 21, including the cover 22 detachably mounted thereon, forms a standing and operation platform for the user to operationally sand thereon and/or operate the fishing equipment thereon during fishing. It is appreciated that, according to the preferred embodiment, the portable and inflatable boat further comprises a collapsible seat unit 50 and, correspondingly, the hard shell body 21 comprises a seat base 23. The seat unit 50 comprises a sitting post 51, which is preferred to be configured extensible, and a collapsible seat member 52 fastened to a top portion of the seat post 51. which is upwardly extended from the upper surface 211 of the hard shell body 20. The seat base 23 is configured to detachably connect a bottom portion of the sitting post 51 of the seat unit 50 in a rotatable manner. Preferably, the seat base 23 is arranged at the upper surface 211 of the hard shell body 20 and positioned adjacent to a curved engaging end 210 thereof, so that the user may sit on the portable and inflatable boat of the present invention in a stable manner while the entire upper surface 211 of the hard shell body 20 engaged with the inflatable floating body 31.

Since the sitting post 51 is rotatably mounted on the hard shell body 20 so that the user may change his or her facing position by rotating the sitting post 51 with respect to the hard shell body 20 while the feet of the user sat on the seat unit 50 can be rest on the upper surface 211 of hard shell body 20 or the top side 301 of the inflatable floating body 31.

According to preferred embodiment, as shown in FIG. 5 and FIG. 6, the hard shell body 20 comprises a pair of wheels 241, 242 rotatably to a lower side of an outer end 210' thereof, wherein the wheels 241, 242 are configured to be rolling on the ground for transportation of the hard shell body 20 with the inflatable floating platform 30 stored in the storage cavity 201 when it is not inflated, or the entire portable and inflatable boat when the inflatable floating body 31 is inflated and engaged with the hard shell body 20, as shown in FIG. 10 to FIG. 13.

It is worth mentioning that the inflatable floating platform 30 further comprises a rudder 35 installed to the bottom side 302 thereof.

In view of above, the portable and inflatable boat of the present invention is a self-secure device which does not involve manual assembling operation such as conducting steps to fasten or to secure the hard shell body 20 with the inflatable floating platform 30. Due to the configuration of the concave engagement groove 200 of the hard shell body 20 and the convex engagement ridge 3120 of the inflatable floating body 31, the portable and inflatable boat can be assembled by the following steps:

positioning the hard shell body 20 in the U-shape mounting slot 300 of the inflatable floating body 31 with a curved engaging end 210 of the hard shell body 20 positioning at a bottom end 3001 of the U-shape mounting slot 300; and inflating the inflatable floating body 31 with air to the predetermined air pressure therein until the convex engagement ridge 3120 of the U-shape inner side 312 of the inflatable floating body 31 presses against the concave engaging surface 214 extended between the upper surface 211 and the lower surface 212 of the hard shell body 20 such that the hard shell body 20 is engaged with the inflatable floating body 31 to form the portable and inflatable boat.

Alternatively, a method of assembling the portable and inflatable boat comprises steps of:

inflating the inflatable floating body 31 with air until the U-shape inner side 312 thereof forming the convex engagement ridge 3120 and defining the U-shape mounting slot 300;

inserting the hard shell body 20 in the U-shape mounting slot 300 of the inflatable floating body 31 via the open end 301 of the U-shape mounting slot 300 until the curved engaging end 210 of the hard shell body 20 positioning at the bottom end 3001 of the U-shape mounting slot 300; and further inflating the inflatable floating body 31 with air to the predetermined air pressure until the convex engagement ridge 3120 of the U-shape inner side 312 of the inflatable floating body 31 presses against the concave engaging surface 214 extended between the upper surface 211 and the lower surface 212 of the hard shell body 20 such that the hard shell body 20 is engaged with the inflatable floating body 31 to form the portable and inflatable boat.

In other words, simply by inflating the inflatable floating body 31, the hard shell body 20 is securely assembled with the inflatable floating body 31 automatically by engaging the convex engagement ridge 3120 with the concave engagement groove 200. In addition, the portable and inflatable boat of the present is light in weight, enabling the user to preassemble and carry directly with a vehicle such as a pickup and or a truck.

It is worth mentioning that the portable and inflatable boat may further comprise a durable rigid C-shape top panel 60 mounted on the inflated floating body 31 so as to combine with the upper surface 211 of the hard shell body 20 to provide an enlarged rigid surface for the user. In addition, multiple handles 36 are able to be mounted on the top side 301 of the inflatable floating body 31 to facilitate one or more passengers sitting on the top panel 60 to grip thereto to enhance stability and balancing of the passengers.

Referring to FIG. 8, for ease of pulling the portable and inflatable boat to rolling on the ground by the wheels 241, 242, the inflatable floating platform 30 comprises connector 37, which is affixed to the outer side 311 at a position opposing the open end 301, adapted for connecting a dragging rope or belt (not shown in FIGURES) for the user to pull for transportation.

It is worth mentioning that the hard shell body 20 is configured to be a container like a suitcase that has the storage cavity 201 provided therein that can be enclosed by the cover 22, so that the user may store the inflatable floating body 31 after deflation in the storage cavity 201 or use the storage cavity 201 to store personal items, fishing equipment and/or even the fishes caught in the storage cavity 201 while the inflatable floating body 31 is inflated and securely engaged with the hard shell body 20 to form the portable and inflatable boat in use. In other words, the hard shell body 20 is a hollow body so that it is light in weight and may also be floatable when the hard shell body 20 is made of plastic or wood.

Furthermore, the portable and inflatable boat of the present invention can also be functioned as a floating platform on a swimming pool or other water surface that swimmers can rest thereon or simply grip to the handles 36.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and are subjected to change without departure from such principles. Therefore, this invention includes all modifications encompassed within the spirit and scope of the following claims.

What is claimed is:

1. A portable and inflatable boat, comprising:

a shell body, comprising a container unit, made of rigid material, having an upper surface, a lower surface, an end surface extended between end sides of said upper surface and said lower surface, and a concave engaging surface extended between said upper surface and said lower surface to define a concave engagement groove; and an inflatable floating platform, comprising an inflatable floating body which is a hollow body made of durable material and has a circular outer side and a U-shape inner side which defines a U-shape mounting slot extended from said outer side to a central portion of said inflatable floating body, wherein said U-shape inner side forms a convex engagement ridge along said U-shape mounting slot when said inflatable floating body is inflated with air therein, wherein said U-shape mounting slot of said inflatable floating body, after inflation, is configured to have a size and a shape to fittingly receive said shell body therein and said convex engagement ridge of said inflatable floating body, after inflation, is shaped and sized to match and press against said concave engaging surface of said container unit of said shell body so as to engage said shell body with said inflated inflatable floating body due to a predetermined air pressure in said inflatable floating body after inflation.

2. The portable and inflatable boat, as received in claim 1, wherein said storage cavity is defined in said container unit and has an upper opening on said upper surface, and that said container body of said shell body further comprises a cover configured to be detachably mounted on said upper surface of said container unit to enclose said storage cavity.

3. The portable and inflatable boat, as recited in claim 1, wherein said shell body has a plurality of engaging ribs spacedly protruded on said concave engaging surface and extended from an upper portion of said concave engaging surface adjacent to said upper surface to a lower portion of said concave engaging surface adjacent to said lower surface, such that after said inflatable floating body is inflated to said predetermined air pressure, each of said plurality of engaging ribs presses against said inner side of said inflated inflatable floating body to provide a friction between said concave engaging surface and said convex engaging surface.

4. The portable and inflatable boat, as recited in claim 2, wherein said shell body has a plurality of engaging ribs spacedly protruded on said concave engaging surface and extended from an upper portion of said concave engaging surface adjacent to said upper surface to a lower portion of said concave engaging surface adjacent to said lower surface, such that after said inflatable floating body is inflated to said predetermined air pressure, each of said plurality of engaging ribs presses against said inner side of said inflated inflatable floating body to provide a friction between said concave engaging surface and said convex engaging surface.

5. The portable and inflatable boat, as recited in claim 1, wherein said shell body comprises a seat base configured to detachably connect a sitting post of a seat unit in a rotatable manner, wherein said seat unit further comprises a seat member connected to a top portion of said sitting post which is upwardly extended from said upper surface of said shell body.

6. The portable and inflatable boat, as recited in claim 5, wherein said seat base is arranged at said upper surface of said shell body and positioned adjacent to a curved engaging end thereof.

7. The portable and inflatable boat, as recited in claim 2, wherein said shell body comprises a seat base configured to detachably connect a sitting post of a seat unit in a rotatable manner, wherein said seat unit further comprises a seat member connected to a top portion of said sitting post which is upwardly extended from said upper surface of said shell body, wherein said seat base is arranged at said upper surface of said shell body and positioned adjacent to a curved engaging end thereof.

8. The portable and inflatable boat, as recited in claim 3, wherein said shell body comprises a seat base configured to detachably connect a sitting post of a seat unit in a rotatable manner, wherein said seat unit further comprises a seat member connected to a top portion of said sitting post which is upwardly extended from said upper surface of said shell body, wherein said seat base is arranged at said upper surface of said shell body and positioned adjacent to a curved engaging end thereof.

9. The portable and inflatable boat, as recited in claim 4, wherein said shell body comprises a seat base configured to detachably connect a sitting post of a seat unit in a rotatable manner, wherein said seat unit further comprises a seat member connected to a top portion of said sitting post which is upwardly extended from said upper surface of said shell body, wherein said seat base is arranged at said upper surface of said shell body and positioned adjacent to a curved engaging end thereof.

10. The portable and inflatable boat, as recited in claim 1, wherein said inflatable floating platform further comprises a bottom panel, which is integrally mounted on a bottom side of said inflatable floating body across said U-shape mounting slot for ensuring said size and said shape of said U-shape mounting slot, guiding an engagement of said inflatable floating body and said shell body after inflation and supporting said bottom surface of said container unit of said shell body.

11. The portable and inflatable boat, as recited in claim 2, wherein said inflatable floating platform further comprises a bottom panel, which is integrally mounted on a bottom side of said inflatable floating body across said U-shape mounting slot for ensuring said size and said shape of said U-shape mounting slot, guiding an engagement of said inflatable floating body and said shell body after inflation and supporting said bottom surface of said container unit of said shell body.

12. The portable and inflatable boat, as recited in claim 3, wherein said inflatable floating platform further comprises a bottom panel, which is integrally mounted on a bottom side of said inflatable floating body across said U-shape mounting slot for ensuring said size and said shape of said U-shape mounting slot, guiding an engagement of said inflatable floating body and said shell body after inflation and supporting said bottom surface of said container unit of said shell body.

13. The portable and inflatable boat, as recited in claim 5, wherein said inflatable floating platform further comprises a bottom panel, which is integrally mounted on a bottom side of said inflatable floating body across said U-shape mounting slot for ensuring said size and said shape of said U-shape mounting slot, guiding an engagement of said inflatable floating body and said shell body after inflation and supporting said bottom surface of said container unit of said shell body.

14. The portable and inflatable boat, as recited in claim 9, wherein said inflatable floating platform further comprises a bottom panel, which is integrally mounted on a bottom side of said inflatable floating body across said U-shape mounting slot for ensuring said size and said shape of said U-shape mounting slot, guiding an engagement of said inflatable floating body and said shell body after inflation and supporting said bottom surface of said container unit of said shell body.

15. The portable and inflatable boat, as recited in claim 1, wherein said shell body comprises one or more wheels rotatably to an outer end thereof, wherein said one or more wheels are configured to be rolling on ground for transportation of said shell body with said inflatable floating body stored in said storage cavity when it is not inflated, or for transportation of said portable and inflatable boat when said inflatable floating body is inflated and engaged with said shell body.

16. The portable and inflatable boat, as recited in claim 2, wherein said shell body comprises one or more wheels rotatably to an outer end thereof, wherein said one or more wheels are configured to be rolling on ground for transportation of said shell body with said inflatable floating body stored in said storage cavity when it is not inflated, or for transportation of said portable and inflatable boat when said inflatable floating body is inflated and engaged with said shell body.

17. The portable and inflatable boat, as recited in claim 3, wherein said shell body comprises one or more wheels rotatably to an outer end thereof, wherein said one or more wheels are configured to be rolling on ground for transportation of said shell body with said inflatable floating body stored in said storage cavity when it is not inflated, or for transportation of said portable and inflatable boat when said inflatable floating body is inflated and engaged with said shell body.

18. The portable and inflatable boat, as recited in claim 5, wherein said shell body comprises one or more wheels rotatably to an outer end thereof, wherein said one or more wheels are configured to be rolling on ground for transportation of said shell body with said inflatable floating body stored in said storage cavity when it is not inflated, or for transportation of said portable and inflatable boat when said inflatable floating body is inflated and engaged with said shell body.

19. The portable and inflatable boat, as recited in claim 10, wherein said shell body comprises one or more wheels rotatably to an outer end thereof, wherein said one or more wheels are configured to be rolling on ground for transportation of said shell body with said inflatable floating body stored in said storage cavity when it is not inflated, or for transportation of said portable and inflatable boat when said inflatable floating body is inflated and engaged with said shell body.

20. The portable and inflatable boat, as recited in claim 14, wherein said shell body comprises one or more wheels rotatably to an outer end thereof, wherein said one or more wheels are configured to be rolling on ground for transportation of said shell body with said inflatable floating body stored in said storage cavity when it is not inflated, or for transportation of said portable and inflatable boat when said inflatable floating body is inflated and engaged with said shell body.

* * * * *